US006120624A

United States Patent [19]

Vogt et al.

[11] Patent Number: 6,120,624

[45] Date of Patent: Sep. 19, 2000

[54] NICKEL BASE SUPERALLOY PREWELD HEAT TREATMENT

[75] Inventors: Russell G. Vogt, Yorktown; Michael G. Launsbach, Newport News; John Corrigan, Yorktown, all of Va.

[73] Assignee: Howmet Research Corporation, Whitehall, Mich.

[21] Appl. No.: 09/108,028

[22] Filed: Jun. 30, 1998

[51] Int. Cl.[7] ..... C21D 9/00

[52] U.S. Cl. ..... 148/675; 148/527; 148/516

[58] Field of Search ..... 148/410, 428, 148/442, 677, 675, 527, 516

[56] References Cited

U.S. PATENT DOCUMENTS

| | | | |
|---|---|---|---|
| 3,741,824 | 6/1973 | Duvall et al. . | |
| 3,871,928 | 3/1975 | Smith et al. | 148/142 |
| 4,039,330 | 8/1977 | Shaw et al. | 75/171 |
| 4,336,312 | 6/1982 | Clark et al. . | |
| 4,676,846 | 6/1987 | Harf . | |
| 5,100,484 | 3/1992 | Wukusick et al. . | |
| 5,328,659 | 7/1994 | Tillman et al. . | |
| 5,417,782 | 5/1995 | Rongvaux . | |
| 5,509,980 | 4/1996 | Lim . | |
| 5,527,403 | 6/1996 | Schirra et al. | 148/675 |

FOREIGN PATENT DOCUMENTS

| | | | |
|---|---|---|---|
| 0711621 | 5/1996 | European Pat. Off. . | |
| 0813930 | 12/1997 | European Pat. Off. . | |
| 3813157 | 12/1988 | Germany | 148/675 |
| 1508099 | 4/1978 | United Kingdom . | |
| 92/13979 | 8/1992 | WIPO . | |

OTHER PUBLICATIONS

"Effect of Homogenization Heat Treatment on the Microstructure and Heat–Affected Zone Microfissuring in Welded Cast Alloy 718" Metallurgical and Materials Transactions, vol. 27 A, Mar., 1996, Huang et al.

*Primary Examiner*—Deborah Yee
*Attorney, Agent, or Firm*—Edward J. Timmer

[57] ABSTRACT

A preweld heat treatment for precipitation hardenable IN939 nickel base superalloy having a gamma matrix and gamma prime strengthening phase dispersed in the matrix comprises heating the nickel base superalloy at about 2120 degrees F. for a time to solution gamma prime phase followed by slow cooling to below about 1450 degrees F. at a rate of about 1 degree F./minute or less, and cooling to room temperature. The preweld heat treatment eliminates strain age cracking at base metal weld heat-affected zone upon subsequent heat treatment to develop alloy mechanical properties.

13 Claims, 9 Drawing Sheets

(D) CONVEX SHROUD REPAIR WELD
(E) CONVEX FILLET REPAIR WELD
(F) CONVEX CHAPLET REPAIR WELD

500 X

M/N 66898
BASE METAL: IN - 939
WELD SIZE: 0.125"
FILLER WIRE: NIMONIC 263

50X

M/N 66898
BASE METAL: IN - 939
WELD SIZE: 0.250"
FILLER WIRE: NIMONIC 263

50X

M/N 66898
BASE METAL: IN - 939
WELD SIZE: 0.500"
FILLER WIRE: NIMONIC 263

50X

M/N 66898
BASE METAL: IN - 939
WELD SIZE: 0.750"
FILLER WIRE: NIMONIC 263

50X

M/N 66899
BASE METAL: IN - 939
WELD SIZE: 0.125"
FILLER WIRE: NIMONIC 263

50X

M/N 66899
BASE METAL: IN - 939
WELD SIZE: 0.250"
FILLER WIRE: NIMONIC 263

50X

M/N 66899
BASE METAL: IN - 939
WELD SIZE: 0.500"
FILLER WIRE: NIMONIC 263

50X

M/N 66899
BASE METAL: IN - 939
WELD SIZE: 0.750"
FILLER WIRE: NIMONIC 263

50X

A - CONCAVE CHAPLET REPAIR WELD (B) LEADING EDGE FILLET REPAIR WELD
(C) Lg STOCK ADDITION REPAIR WELD (D) CONVEX SHROUD REPAIR WELD
(E) CONVEX FILLET REPAIR WELD
(F) CONVEX CHAPLET REPAIR WELD

CONCAVE CHAPLET REPAIR 50X

CONCAVE CHAPLET REPAIR 200X

LE FILLET WELD 50X

LE FILLET WELD 200X

LG. STOCK ADDITION 50X

LG. STOCK ADDITION 200X

NICKEL BASE SUPERALLOY PREWELD HEAT TREATMENT

FIELD OF THE INVENTION

The present invention relates to the heat treatment of a precipitation hardenable nickel base superalloys prior to welding to impart improved weldability thereto.

BACKGROUND OF THE INVENTION

Precipitation hardenable nickel base superalloys of the gamma-gamma prime type are extensively used for gas turbine engine components. Many of these nickel base superalloys are difficult to fusion weld from the standpoint that cracking in the base metal heat-affected zone occurs during subsequent heat treatment to develop alloy mechanical properties (i.e. strain age cracking). One such precipitation hardenable nickel base superalloy is known as IN 939 having a nominal composition, in weight %, of 0.14% C, 22.58% Cr, 2.00% W, 19.00% Co, 1.90% Al, 3.75% Ti, 1.00% Nb, 1.40% Ta, and balance essentially Ni and strengthened by precipitation of gamma prime phase in the gamma phase matrix during subsequent heat treatment following welding. This alloy is considered to be only marginably weldable and to be highly susceptible to strain age cracking where objectionable cracking develops in the base metal heat-affected zone after welding during heat treatment to develop alloy mechanical properties.

A previously developed preweld heat treatment to avoid strain age cracking in IN 939 investment castings involved heating to 2120 degrees F. for 4 hours followed by slow cool at 1 degree F./minute or less to 1832 degrees F. and hold at that temperature for 6 hours followed by slow cool at 1 degree F. or less to below 1200 F. and finally gas fan cool to room temperature. However, the preweld heat treatment required 32 hours from start to completion, increasing the cost and complexity of manufacture of investment cast IN 939 components and necessitating long lead times and increased furnace capacity.

An object of the present invention is to provide a relatively short time preweld heat treatment that renders difficult or marginably weldable precipitation hardenable nickel base superalloys, such as the IN 939 nickel base superalloy, readily weldable without weld associated cracking during post-weld heat treatment.

Another object of the present invention is to provide a relatively short time preweld heat treatment that renders difficult or marginably weldable precipitation hardenable nickel base superalloys readily weldable without the need for alloy compositional modifications and without the need for changes to otherwise conventional fusion welding procedures.

SUMMARY OF THE INVENTION

One embodiment of the present invention provides a relatively short time preweld heat treatment for the aforementioned IN 939 nickel base superalloy that transforms the marginably weldable alloy microstructure to a weldable microstructural condition that can be conventionally fusion welded without objectionable strain age cracking during subsequent post-weld heat treatment to develop alloy mechanical properties. The heat treatment is especially useful, although not limited, to heat treatment of investment cast IN 939 components to impart weldability thereto to an extent that the casting defects can be repaired by filler metal fusion welding without objectionable strain age cracking.

In a particular embodiment of the present invention, the preweld heat treatment comprises heating the IN 939 nickel base superalloy at about 2120 degrees F. plus or minus 15 degrees F. for about 4 hours plus or minus 15 minutes to solution the gamma prime phase followed by slow cooling to below about 1450 degrees F., preferably below about 1250 degrees F., at a rate of about 3 degrees F./minute or less, preferably about 1 degree F./minute, effective to produce an overaged microstructure in which most of the gamma prime phase is precipitated in the gamma matrix. Then, the superalloy is cooled to room temperature, such as gas fan cooled (GFC) to room temperature using flowing argon gas to speed up the cooling step, although slower cooling to room temperature can be used in practice of the invention. IN 939 investment castings preweld heat treated in this manner can be conventionally filler metal fusion welded [e.g. tungsten inert gas (TIG) welded] to repair casting defects or service defects, such as thermal cracks, without occurrence of strain age cracking during heat treatment to develop alloy mechanical properties.

The preweld heat treatment of the present invention is not limited for use with IN 939 precipitation hardenable nickel base superalloy and can be practiced and adapted for use with other difficult or marginably weldable precipitation hardenable nickel base superalloys to the benefit of these superalloys from the standpoint of imparting improved weldability thereto.

The above objects and advantages of the present invention will become more readily apparent from the following detailed description taken with the following drawings.

DETAILED DESCRIPTION OF THE INVENTION

Figure 1:
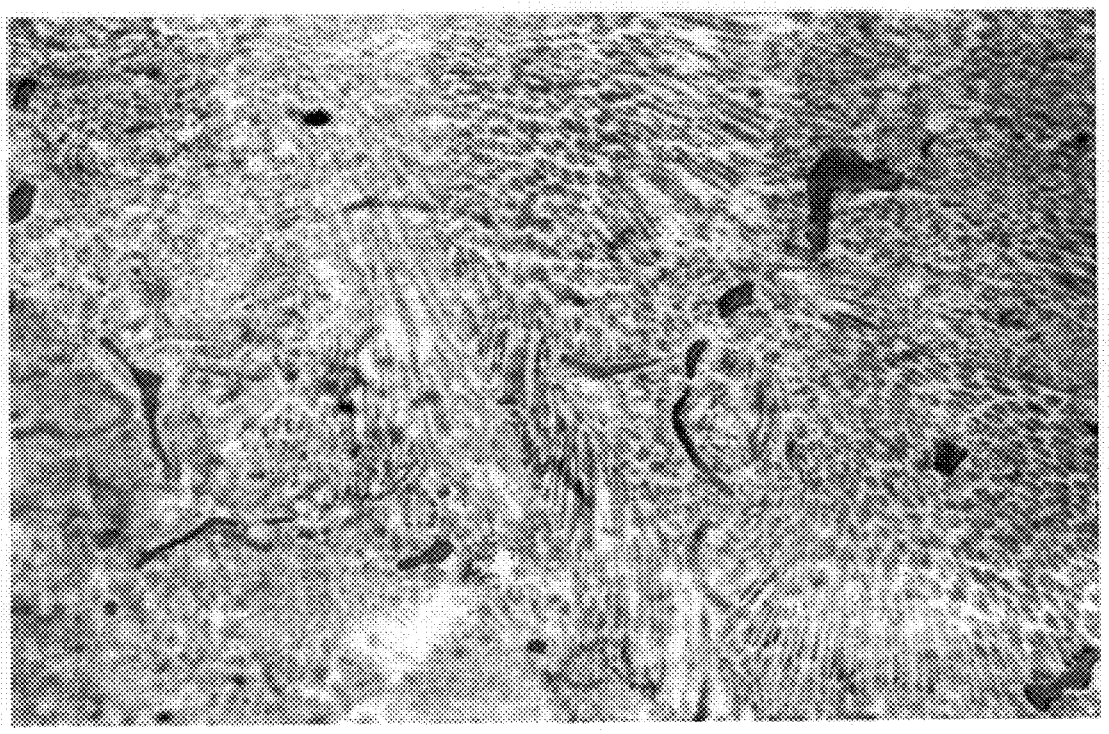
FIG. 1 is a photomicrograph at 500× of the IN939 microstructure after the preweld heat treatment of the invention.
Figure 2A:
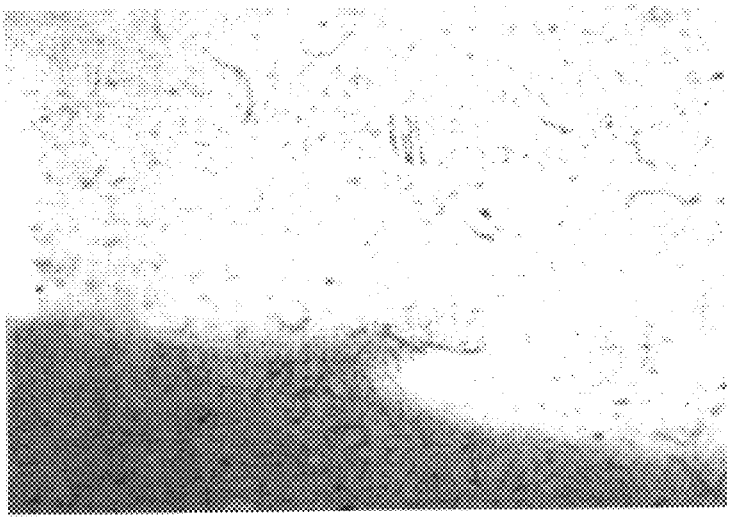
FIGS. 2A through FIG. 2H are photomicrographs at 50× of the IN 939 microstructure after fusion welding using filler wire and after a three phase heat treatment for two test coupons each with the different weld sizes to develop alloy mechanical properties.
Figure 2B:
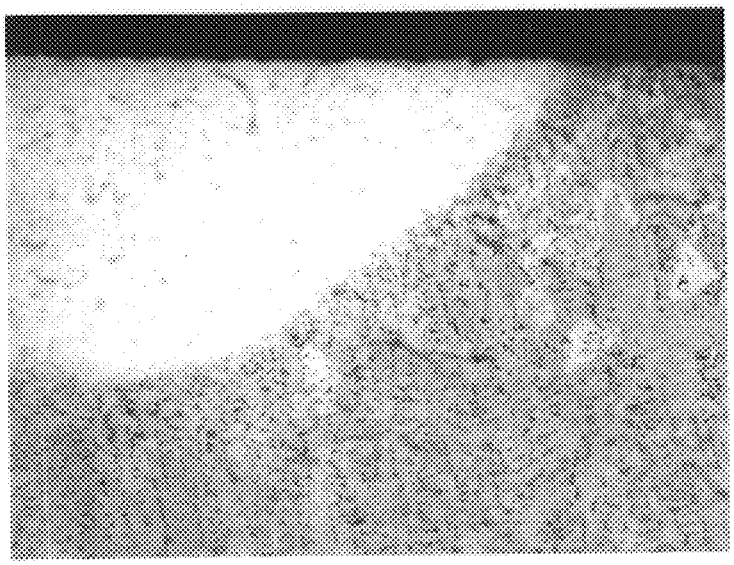
Figure 2C:
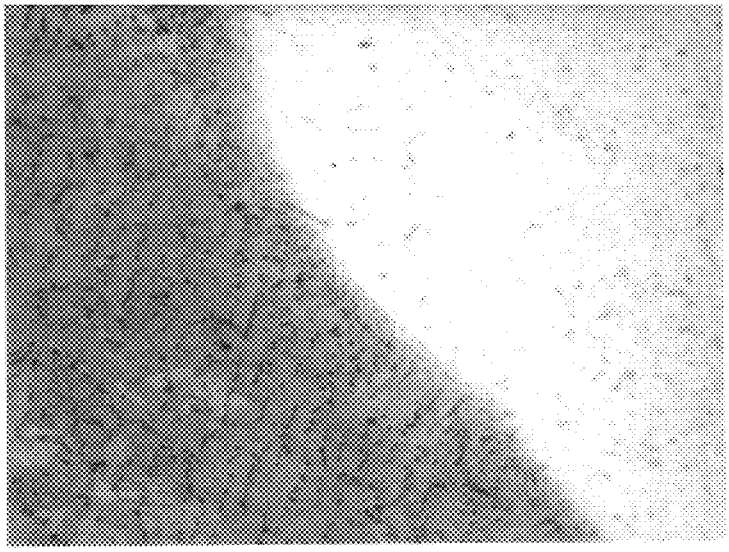
Figure 2D:
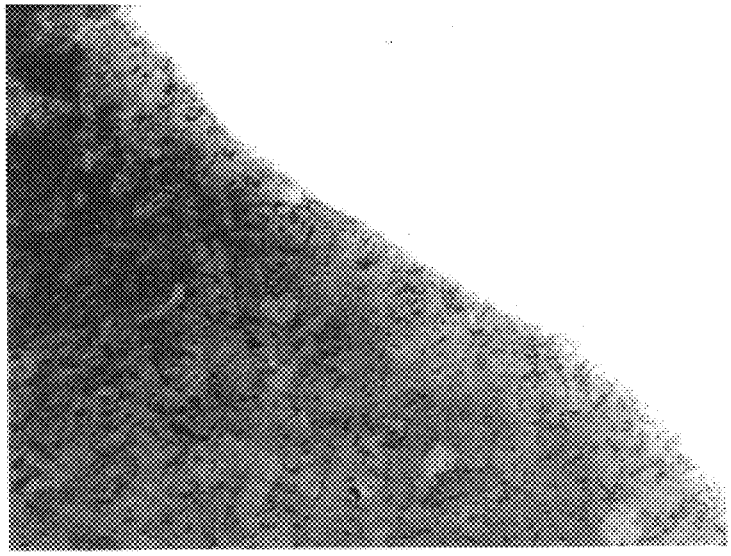
Figure 2E:
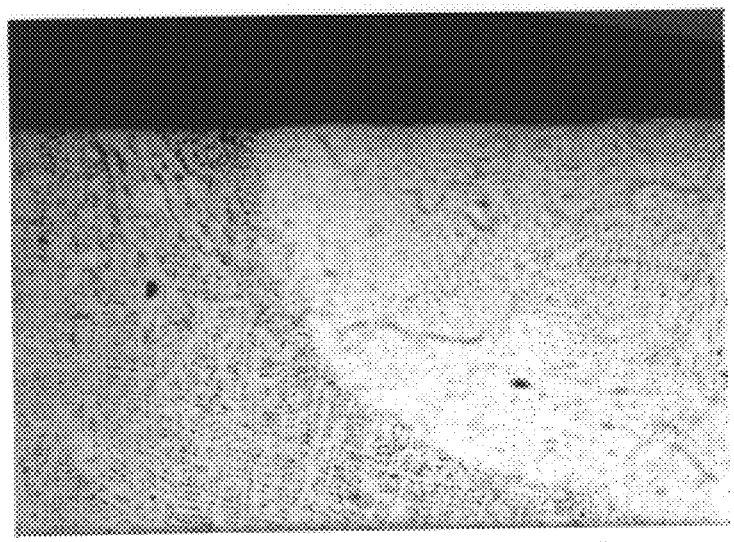
Figure 2F:
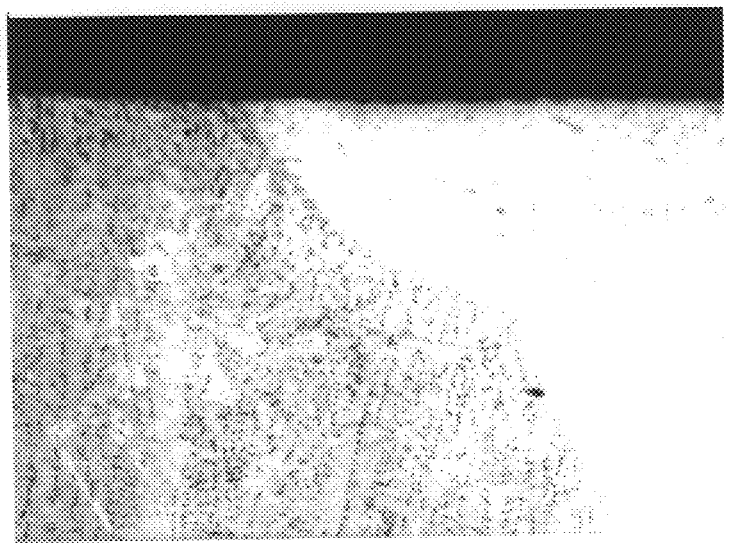
Figure 2G:
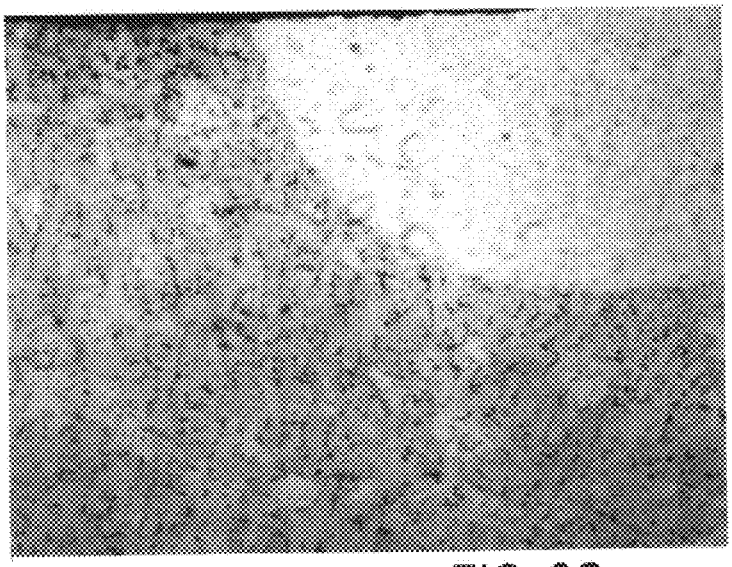
Figure 2H:
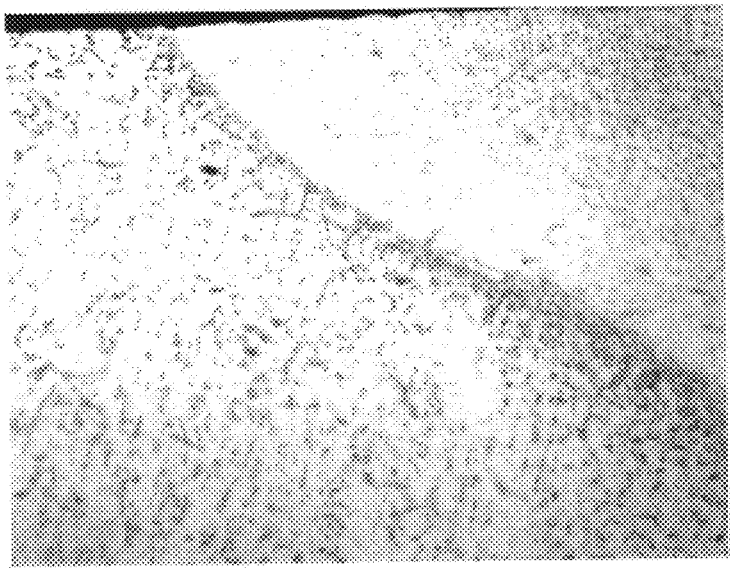

A preweld heat treatment of the present invention will be described herebelow in connection with IN939 precipitation hardenable nickel base superalloy having an alloy composition consisting essentially, in weight percent, of about 22.0 to 22.8% Cr, about 18.5 to 19.5% Co, about 3.6 to 3.8% Ti, about 1.8 to 2.0% Al, about 1.8 to 2.2% W, about 0.9 to 1.1%

Nb, about 1.3 to 1.5% Ta, about 0.13 to 0.17% C, and balance essentially Ni. Table I sets forth the alloy composition including typical ranges for impurity elements present in the alloy, where the numbers represent weight percentage of a particular element.

TABLE I

| ELEMENT | MINIMUM | MAXIMUM |
|---|---|---|
| CHROMIUM | 22.0 | 22.8 |
| COBALT | 18.5 | 19.5 |
| TITANIUM | 3.6 | 3.8 |
| ALUMINUM | 1.8 | 2.0 |
| TUNGSTEN | 1.8 | 2.2 |
| NIOBIUM | 0.9 | 1.1 |
| TANTALUM | 1.3 | 1.5 |
| NICKEL | BAL | BAL |
| CARBON | 0.13 | 0.17 |
| ZIRCONIUM | | 0.14 |
| BORON | 0.014 | |
| IRON | | 0.5 |
| SULPHUR | | 0.005 |
| SILVER | 0.0005 | |
| BISMUTH | | 0.00005 |
| SILICON | | 0.2 |
| MANGANESE | | 0.2 |
| LEAD | | 0.0050 |
| NITROGEN | | 0.005 |

Although the invention will be illustrated with respect to IN939 nickel base superalloy, it can be practiced and adapted for use with other difficult or marginably weldable precipitation hardenable nickel base superalloys to the benefit of these superalloys from the standpoint of imparting improved weldability thereto. Such nickel base superalloys include, but are not limited to, Duranickel 301, Udimet 500, Udimet 700, Rene 41 and GMR 235.

Generally, the preweld heat treatment of the invention involves heating the nickel base superalloy to a temperature above about 2100 degrees F., which is above the gamma prime solvus temperature, and below the incipient alloy melting temperature, for a time to completely solution the gamma prime phase followed by slow, uninterrupted cooling to a lower temperature at least 650 degrees F. below the gamma prime solvus temperature at a rate of about 3 degrees F./minute or less, preferably 1 degree F./minute or less, effective to produce an overaged microstructure in which most or all of the gamma prime phase is precipitated in the gamma matrix. Then, the superalloy is cooled to room temperature. For example only, the superalloy can be cooled to room temperature using conventional gas fan cooling (GFC) using flowing argon gas to speed up the cooling step, although slow cooling to room temperature also can be used in practice of the invention.

For the aforementioned IN939 nickel base superalloy, the preweld heat treatment comprises heating the IN939 superalloy at about 2120 degrees F. plus or minus 15 degrees F. for about 4 hours plus or minus 15 minutes to solution the gamma prime phase followed by slow cooling to below about 1450 degrees F., preferably below about 1250 degrees F., at a rate of about 1 degree F. or less effective to produce an overaged microstructure in which most of the gamma prime phase is precipitated in the gamma matrix. Then, the superalloy is gas fan cooled (GFC) to room temperature. The heating rate to the 2120 degree F. solution temperature typically is 50 degrees F./minute, although other heating rates can be used in the practice of the invention.

The preweld heat treated nickel base superalloy then is fusion welded in a conventional manner using, for example, TIG and other fusion welding techniques. For example, the repair or refurbishment of nickel base superalloy investment castings can involve repair of as-cast defects or defects, such as thermal cracks, resulting from service in a turbine engine. The investment casting typically is filler metal fusion welded to repair such defects with the filler being selected to be compatible compositonally to the particular nickel base superalloy being repaired or refurbished.

For IN 939 investment castings having as-cast defects, such as non-metallic inclusions or microporosity, the castings can be preweld heat treated as described above and weld repaired using Nimonic 263 (nominal composition, in weight %, of 20% Cr, 20% Co, 2.15% Ti, 5.9% Mo, 0.45% Al, 0.06% C, balance Ni) filler wire and standard TIG (tungsten inert gas) welding parameters. The invention is not limited to any particular filler wire or to any particular welding procedure, however.

Following fusion welding, the welded nickel base superalloy typically is heat treated in conventional manner to develop desired alloy mechanical properties. For example, for the IN939 nickel base superalloy, the welded superalloy is heat treated at 2120 degrees F. for 4 hours and gas fan cooled to 1832 degrees F. The superalloy is held at 1832 degrees F. for 6 hours followed by gas fan cooling with flowing argon gas to 1475 degrees F. and held there for 16 hours followed by gas fan cooling to room temperature.

For purposes of illustration and not limitation, the present invention will be described with respect to preweld heat treatment of IN939 investment castings having a nominal composition, in weight %, of 0.14% C, 22.58% Cr, 2.00% W, 19.00% Co, 1.90% Al, 3.75% Ti, 1.00% Nb, 1.40% Ta, and balance essentially Ni.

Initial welding tests were conducted using two IN939 weld test coupons each having dimensions of 8 inches length and 3 inches width with four surface steps spaced 1.5 inches apart of 0.125 inch, 0.25 inch, 0.5 inch, and 0.75 inch height. The test coupons were investment cast from IN939 alloy to have an equiaxed microstructure. The test coupons included the 0.125 inch, 0.250 inch, 0.500 inch, and 0.750 inch thick steps with dished out weld sites. Each coupon was preweld heat treated at 2120 degrees F. for 4 hours to solution the gamma prime phase followed by slow cooling to below 1250 degrees F. at a rate of 1 degree F./minute effective to produce an averaged microstructure in which most of the gamma prime phase is precipitated in the gamma matrix. Then, the superalloy coupon was gas fan cooled (GFC) to room temperature. The test coupons then were TIG welded using Nimonic 263 filler wire and standard welding parameters. Following welding, the test coupons were subjected to a three phase heat treatment to develop alloy mechanical properties comprising heating at 2120 degrees F. for 4 hours, then gas fan cooling to 1832 degrees F. and holding for 6 hours followed by gas fan cooling to 1475 degrees F. and holding there for 16 hours followed by gas fan cooling to room temperature.

FIG. 1 is a photomicrograph at 500× of an IN939 coupon microstructure after the preweld heat treatment of the invention and prior to welding. The microstructure comprises an overaged weldable microstructure comprising a gamma matrix having coarse gamma prime precipitated throughout the matrix. Most, if not all, (e.g. at least 90%) of the gamma prime phase is precipitated in the matrix.

FIGS. 2A–2D and FIGS. 2E–2H are photomicrographs at 50× of the IN939 weld heat-affected zone microstructure of the different size welds (i.e. 0.125 inch, 0.250 inch, 0.500 inch, and 0.750 inch welds) of the test coupons after fusion welding using filler wire and after the three phase heat treatment to develop alloy mechanical properties. It is apparent that the weld heat-affected zone is free of strain age cracking and other weld defects in all of the welded/three phase heat treated test coupons.

Figure 3A:
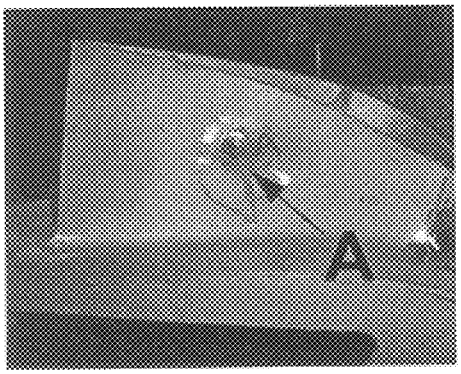
FIGS. 3A, 3B, 3C are perspective views illustrating various regions of a vane segment repaired by filler wire welding pursuant an embodiment of the present invention
Figure 3B:
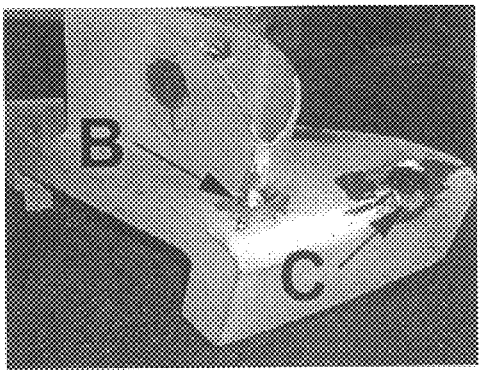
Figure 3C:
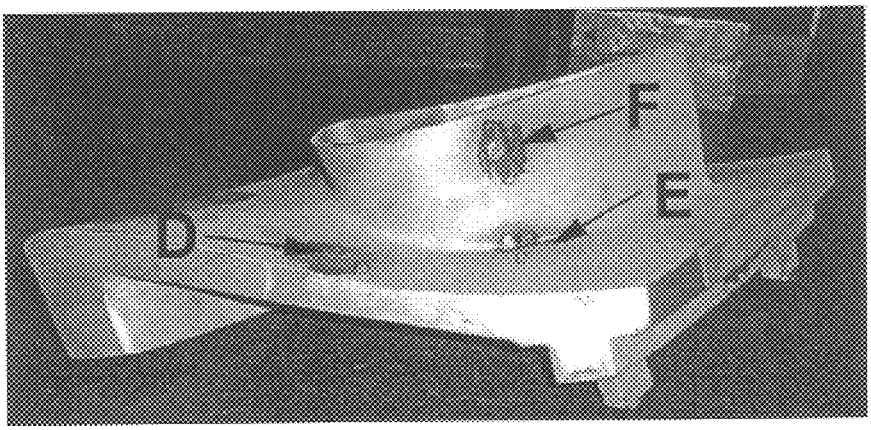

For purposes of still further illustration and not limitation, the present invention will be described with respect to weld repair of a gas turbine engine vane segment investment cast from IN939 nickel base superalloy having the nominal composition set forth above. The vane segment was preweld heat treated as described above for the test coupons. Then, the vane segment was weld repaired using Nimonic 263 filler wire and standard TIG welding parameters. Weld repairs were made at a concave chaplet as shown at area A of FIG. 3A, at LE (leading edge) fillet as shown at area B of FIG. 3B, as large stock addition as shown at area C also of FIG. 3B, as a convex shroud repair as shown at area D of FIG. 3C, at a convex fillet as also shown at area E of FIG. 3C, at convex chaplet as also shown at area F of FIG. 3C, as outer shroud thick-to-thin fillet weld (not shown), and as outer shroud equal mass fillet weld (not shown). Following weld repair, the vane segment was subjected to the three phase heat treatment described above for the test coupons.

Figure 4A:
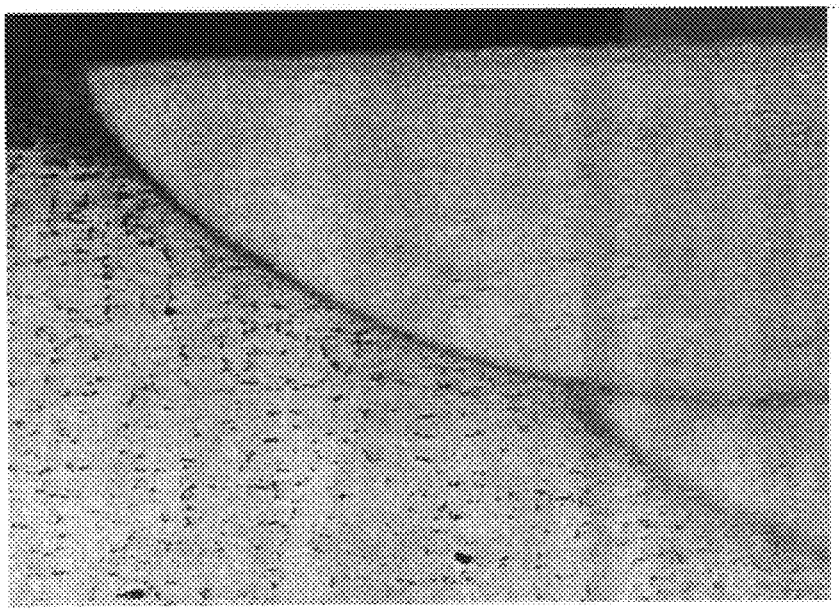
FIGS. 4A, 4B are photomicrographs at 50× and 200×, respectively, of the IN 939 weld/base metal microstructure at the concave chaplet weld repair area after a three phase heat treatment to develop alloy mechanical properties.
Figure 4B:
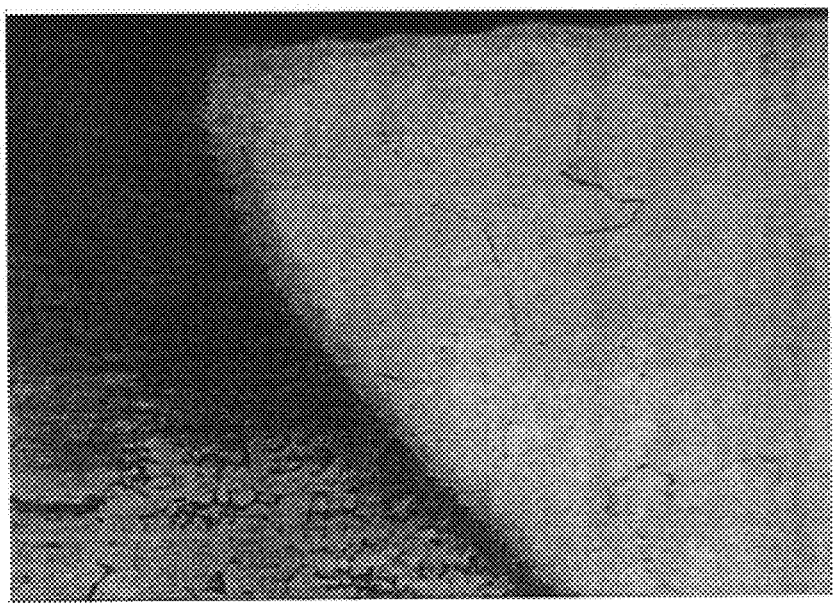
Figure 5A:
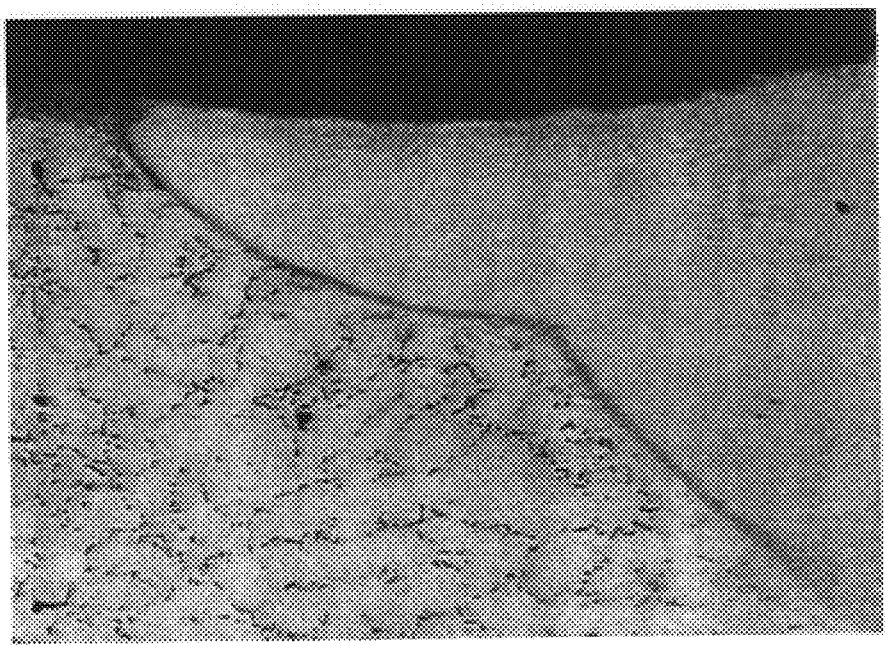
FIGS. 5A, 5B are photomicrographs at 50× and 200×, respectively, of the IN 939 weld/base metal microstructure at the leading edge (LE) fillet weld repair area after the three phase heat treatment to develop alloy mechanical properties.
Figure 5B:
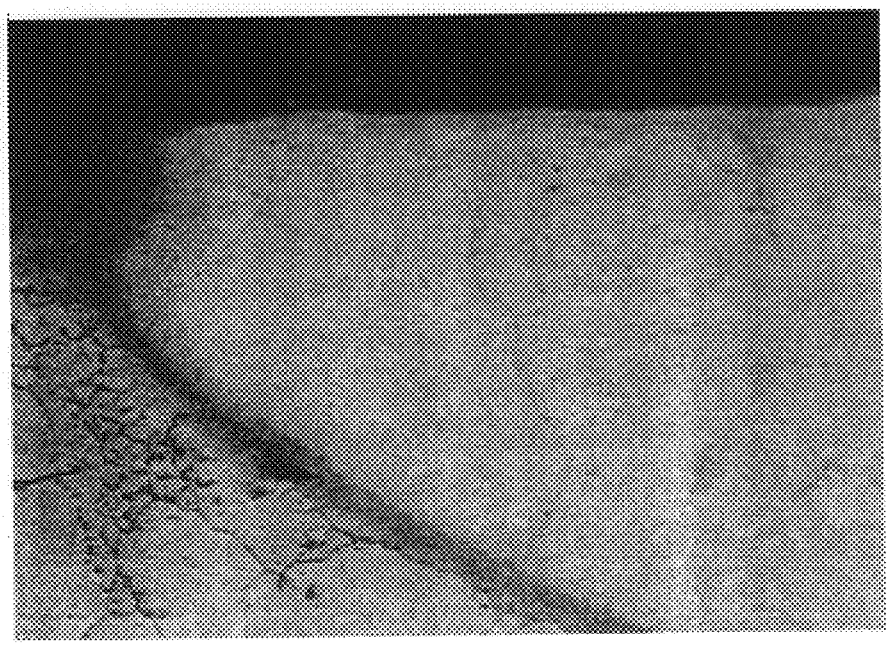

FIGS. 4A, 4B are photomicrographs at 50× and 200×, respectively, of the IN939 weld/base metal microstructure at the concave chaplet weld repair area after the three phase heat treatment to develop alloy mechanical properties. It is apparent that the base metal weld heat-affected zone is free of strain age cracking and other weld defects in all of the welded/three phase heat treated test coupons. FIGS. 5A, 5B are photomicrographs at 50× and 200× of the IN 939 weld/base metal microstructure at the leading edge (LE) fillet weld repair area after the three phase heat treatment to develop alloy mechanical properties. It is apparent that the base metal weld heat-affected zone is free of strain age cracking and other weld defects in all of the welded/three phase heat treated test coupons.

Figure 6A:
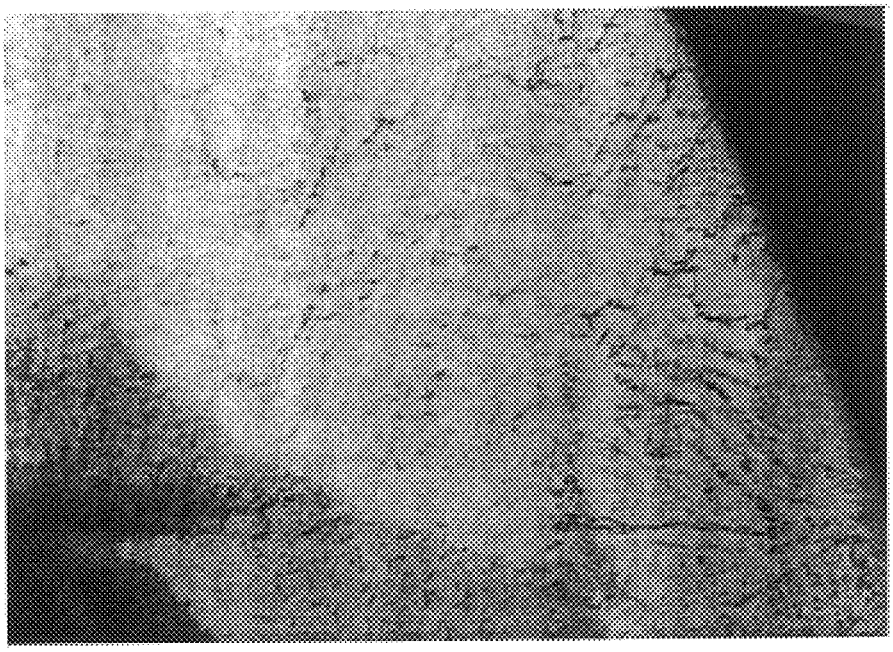
FIGS. 6A, 6B are photomicrographs at 50× and 200×, respectively, of the IN 939 weld/base metal microstructure at the large filler addition (lg. stock addition) weld repair area after the three phase heat treatment to develop alloy mechanical properties.
Figure 6B:
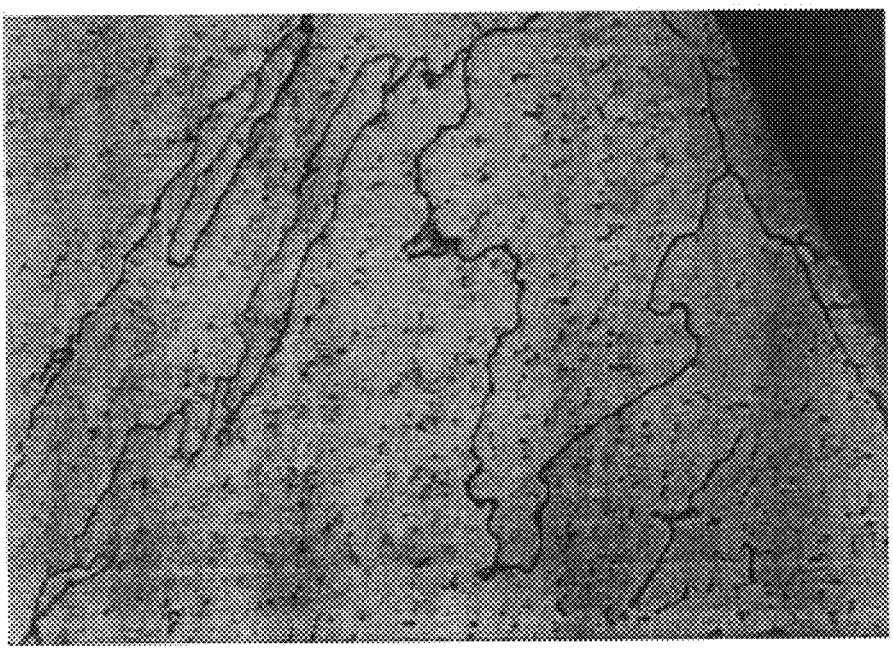

FIGS. 6A, 6B are photomicrographs at 50× and 200× of the IN 939 weld/base metal microstructure at the large stock addition weld repair area after the three phase heat treatment. It is apparent that the base metal weld heat-affected zone is free of strain age cracking and other weld defects in all of the welded/three phase heat treated test coupons. The heat-affected zones at the other weld repaired locations of the two vane segment likewise were free of strain age cracking and other weld defects. The present invention was effective to weld repair the IN 939 investment cast vane segment using conventional filler metal fusion welding without occurrence of strain age cracking during the three phase heat treatment to develop alloy mechanical properties. While the persent invention has been described in terms of specific embodiments thereof, it is not intended to be limited thereto but rather only to the extent set forth in the following claims.

We claim:

1. A preweld heat treatment for a precipitation hardenable nickel base superalloy casting consisting essentially of, in weight %, about 22.0 to 22.8% Cr, about 18.5 to 19.5% Co, about 3.6 to 3.8% Ti, about 1.8 to 2.0% Al, about 1.8 to 2.2% W, about 0.9 to 1.1% Nb, about 1.3 to 1.5% Ta, about 0.13 to 0.17% C, and balance essentially Ni to avoid strain age cracking during post-weld heat treatment, comprising:

heating the nickel base superalloy casting at about 2120 degrees F. plus or minus 15 degrees for a time to solution gamma prime phase followed by slow cooling to below about 1450 degrees F. at a rate to produce an overaged microstructure in which most of the gamma prime phase is precipitated in a gamma matrix, and cooling to room temperature.

2. The heat treatment of claim 1 wherein the nickel base superalloy casting is heated at 2120 degrees F. plus or minus 15 degrees F. for 4 hours plus or minus 15 minutes.

3. The heat treatment of claim 1 wherein the nickel base superalloy casting is slow cooled to below about 1250 degrees F. at a rate of about 3 degrees F./minute or less.

4. The heat treatment of claim 3 wherein the nickel base superalloy casting is slow cooled at a rate of about 1 degree F./minute or less.

5. A preweld heat treatment for a precipitation hardenable nickel base superalloy having a gamma matrix and gamma prime phase dispersed in the matrix to avoid strain age cracking during a post-weld heat treatment, comprising:

heating the nickel base superalloy to a temperature above a gamma prime solvus temperature and below an incipient alloy melting temperature, for a time to solution the gamma prime phase followed by slow, uninterrupted cooling to a lower temperature at least 650 degrees F. below the gamma prime solvus temperature at a rate of about 3 degrees F./minute or less effective to produce an overaged microstructure in which most of the gamma prime phase is precipitated in the gamma matrix, and cooling to room temperature.

6. The heat treatment of claim 5 wherein the nickel base superalloy is heated to above about 2100 degrees F. to solution the gamma prime phase.

7. A method of welding and heat treating a precipitation hardenable nickel base superalloy casting consisting essentially of, in weight %, about 22.0 to 22.8% Cr, about 18.5 to 19.5% Co, about 3.6 to 3.8% Ti, about 1.8 to 2.0% Al, about 1.8 to 2.2% W, about 0.9 to 1.1% Nb, about 1.3 to 1.5% Ta, about 0.13 to 0.17% C, and balance essentially Ni, comprising:

prior to welding, heating the nickel base superalloy casting at about 2120 degrees F. plus or minus 15 degrees for a time to solution gamma prime phase followed by slow cooling to below about 1450 degrees F. at a rate of about 3 degrees F./minute or less, and cooling to room temperature, welding the nickel base superalloy casting to produce a heat-affected zone therein, and heat treating the welded nickel base superalloy to develop mechanical properties wherein said heat-affected zone is free of strain age cracking.

8. The method of claim 7 wherein the nickel base superalloy casting is heated at 2120 degrees F. plus or minus 15 degrees F. for 4 hours plus or minus 15 minutes.

9. The method of claim 7 wherein the nickel base superalloy casting is slow cooled to below about 1250 degrees F. at a rate of about 1 degree F./minute or less.

10. The method of claim 7 to repair casting defects of said casting.

11. A method of welding and heat treating a precipitation hardenable nickel base superalloy having a gamma matrix and gamma prime phase dispersed in the matrix, comprising:

prior to welding, heating the nickel base superalloy to a temperature above a gamma prime solvus temperature and below an incipient alloy melting temperature, for a time to solution the gamma prime phase followed by slow, uninterrupted cooling to a lower temperature at least 650 degrees F. below the gamma prime solvus temperature at a rate of about 3 degrees F./minute or less effective to produce an overaged microstructure in which most of the gamma prime phase is precipitated in the gamma matrix, and cooling to room temperature, welding the nickel base superalloy to produce a heat-affected zone therein, and heat treating the welded nickel base superalloy to develop mechanical properties wherein said heat-affected zone is free of strain age cracking.

12. The method of claim 11 wherein the nickel base superalloy is heated to above about 2100 degrees F. to solution the gamma prime phase.

13. The method of claim 11 to repair casting defects of a cast component comprising said nickel base superalloy.

* * * * *